US011684961B2

(12) United States Patent
Yokoi et al.

(10) Patent No.: US 11,684,961 B2
(45) Date of Patent: Jun. 27, 2023

(54) ROLLER HEMMING DEVICE AND PRELIMINARY BENDING METHOD USING THE DEVICE

(71) Applicant: SUBARU CORPORATION, Tokyo (JP)

(72) Inventors: Masahiro Yokoi, Tokyo (JP); Yoshihiro Kanaya, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 212 days.

(21) Appl. No.: 16/837,488

(22) Filed: Apr. 1, 2020

(65) Prior Publication Data

US 2020/0338617 A1 Oct. 29, 2020

(30) Foreign Application Priority Data

Apr. 25, 2019 (JP) ..... JP2019-083917

(51) Int. Cl.
*B21D 19/08* (2006.01)
*B21D 39/02* (2006.01)

(52) U.S. Cl.
CPC ..... *B21D 19/08* (2013.01); *B21D 39/023* (2013.01); *B21D 19/082* (2013.01); *B21D 39/02* (2013.01); *B21D 39/021* (2013.01); *B21D 39/026* (2013.01)

(58) Field of Classification Search
CPC .... B21D 39/02; B21D 39/021; B21D 39/023; B21D 39/026; B21D 19/08; B21D 19/082
See application file for complete search history.

(56) References Cited

U.S. PATENT DOCUMENTS 6,814,106 B1 * 11/2004 Iizuka ..... F24F 13/0254 138/DIG. 4
7,500,373 B2 * 3/2009 Quell ..... B21D 39/023 72/212

(Continued)

FOREIGN PATENT DOCUMENTS

JP 5-78327 U 10/1993
JP 2003-103325 A 4/2003

(Continued)

OTHER PUBLICATIONS

Notice of Reasons for Refusal issued in Japanese Patent Application No. 2019-083917 dated Nov. 16, 2022, with English machine translation.

*Primary Examiner* — Sarang Afzali
*Assistant Examiner* — Darrell C Ford
(74) *Attorney, Agent, or Firm* — Troutman Pepper Hamilton Sanders LLP

(57) ABSTRACT

A roller hemming device includes a backing metal, a guide roller, a bending roller, a pressing unit, and a swinging unit. The backing metal includes an abutment surface and a guide surface. The abutment surface is brought into abutment against a first panel member. The guide roller is moved in an extending direction of the guide surface with abutting against the guide surface. With being moved synchronously with the guide roller, the bending roller presses a bent peripheral edge portion of the first panel member via the backing metal such that the bent peripheral edge portion of the first panel member is pinched between the bending roller and the guide roller, and folds the bent peripheral edge portion of the first panel member back to a periphery edge portion of a second panel member. The pressing unit presses the bending roller toward the backing metal.

11 Claims, 5 Drawing Sheets

(56) References Cited

U.S. PATENT DOCUMENTS

| | | | | |
|---|---|---|---|---|
| 7,950,260 | B2 * | 5/2011 | Kinouchi | B21D 19/04 72/220 |
| 8,272,243 | B2 * | 9/2012 | Hasegawa | B21D 39/021 72/220 |
| 9,925,579 | B2 * | 3/2018 | Yoshimichi | B21D 39/023 |
| 10,994,322 | B2 * | 5/2021 | Nogami | B21D 53/88 |
| 2008/0250835 | A1 * | 10/2008 | Hasegawa | B21D 39/021 72/220 |
| 2010/0154503 | A1 * | 6/2010 | Hasegawa | B21D 39/023 72/199 |
| 2010/0313621 | A1 * | 12/2010 | Kumagai | B21D 39/021 72/220 |
| 2011/0131778 | A1 * | 6/2011 | Jang | B21D 39/023 29/243.58 |
| 2018/0133780 | A1 * | 5/2018 | Nogami | B21D 53/88 |

FOREIGN PATENT DOCUMENTS

| | | | |
|---|---|---|---|
| JP | 2007-229723 | A | 9/2007 |
| JP | 2008-12572 | A | 1/2008 |

* cited by examiner

ROLLER HEMMING DEVICE AND PRELIMINARY BENDING METHOD USING THE DEVICE

CROSS REFERENCE TO RELATED APPLICATIONS

The present application claims priority from Japanese Patent Application No. 2019-083917 filed on Apr. 25, 2019, the entire contents of which are hereby incorporated by reference.

BACKGROUND

The disclosure relates to a roller hemming device and a preliminary bending method using the device, and in particular, relates to a roller hemming device that brings superimposed panel members into abutment against a backing metal, pressing a peripheral edge portion of one of the panel members such that the peripheral edge portion is pinched between a guide roller and a bending roller, and folds the peripheral edge portion of the one panel member back to a peripheral edge portion of the other panel member, and a preliminary bending method using the device.

In a roller hemming process, superimposed panel members are brought into abutment against a surface (that is abutment surface) of a backing metal, and a guide roller is brought into abutment against a guide surface, opposite to the abutment surface, of the backing metal. A bending roller is disposed on the opposite side of the guide roller across the backing metal and the superimposed panel members. The bending roller and the guide roller press the backing metal and the superimposed panel members such that the backing metal and the superimposed panel members are pinched between the bending roller and the guide roller. Among the two superimposed panel members, a peripheral edge portion of a first panel member closer to the backing metal is normally pre-bent substantially perpendicular to a panel plate surface. The bending roller presses the pre-bent peripheral edge portion so as to fold the pre-bent peripheral edge portion back to a peripheral edge portion of a second panel member. For example, a pressing unit such as an air cylinder or a servo motor is used for pressing of the bending roller.

As described in Japanese Unexamined Patent Application Publication (JP-A) No. 2003-103325, in such a roller hemming process, a preliminary bending process is often performed prior to a so-called formal bending process. In the preliminary bending process, the peripheral edge portion of the first panel member is folded at a predetermined bending angle back to the peripheral edge portion of the second panel member. In the formal bending process, the peripheral edge portion of the first panel member is completely pressed against the peripheral edge portion of the second panel member. For this purpose, the bending roller that performs the preliminary bending process is provided with a tapered portion having a substantially conical surface. The preliminary bending process is performed in the following manner. That is, the tapered portion is brought into abutment against the pre-bent peripheral edge portion of the first panel member (hereinafter, also referred to as a "first panel peripheral edge portion"), and the peripheral edge portion of the first panel member is pressed so as to be pinched between the tapered portion of the bending roller and the guide roller, so that a first panel peripheral edge portion is folded at the predetermined bending angle with respect to the panel plate surface, back to the peripheral edge portion of the second panel member.

An angle between the peripheral edge portion of the first panel member after the preliminary bending process and the panel plate surface is defined as the bending angle of the first panel peripheral edge portion from the panel plate surface. There is also a hemming process in which a bending roller presses and folds a panel member superimposed on a lower die. However, the roller hemming process here refers to a hemming process in which a backing metal and superposed panel members are pinched between a guide roller and a bending roller so as to fold the peripheral edge portion of one of the panel members.

SUMMARY

An aspect of the disclosure provides a roller hemming device. The device includes a backing metal, a guide roller, a bending roller, a pressing unit, and a swinging unit. The backing metal includes an abutment surface and a guide surface opposite to the abutment surface. The abutment surface is configured to be brought into abutment against a first panel member among the first panel member and a second panel member superimposed with the first panel member. The guide roller is configured to be moved in an extending direction of the guide surface with abutting against the guide surface. The bending roller is configured to, with being moved synchronously with the guide roller, press a bent peripheral edge portion of the first panel member via the backing metal such that the bent peripheral edge portion of the first panel member is pinched between the bending roller and the guide roller, and fold the bent peripheral edge portion of the first panel member back to a periphery edge portion of the second panel member. The pressing unit is configured to press the bending roller toward the backing metal. When viewed in a moving direction of the guide roller, at least one of the guide surface or an outer peripheral surface of the guide roller configured to be brought into abutment against the guide surface is a curved surface that is convex in a direction in which the bent peripheral edge portion of the first panel member is pinched between the bending roller and the guide roller. The swinging unit is configured to swing the guide roller and the bending roller integrally in a plane perpendicular to the moving direction of the guide roller, with the guide surface and the outer peripheral surface abutting against each other.

An aspect of the disclosure provides a preliminary bending method using the above-described roller hemming device. The method includes, during two or more folding-back steps each including the bending roller folding back the peripheral edge portion of the first panel member along with synchronous movement with the guide roller, controlling a swinging state of the guide roller and the bending roller caused by the swinging unit such that a bending angle of the peripheral edge portion of the first panel member from a panel plate surface of the first panel member in a subsequent folding-back step is smaller than that in a preceding folding-back step.

An aspect of the disclosure provides a preliminary bending method using the above-described roller hemming device. The method includes, during one folding-back step including the bending roller folding back the peripheral edge portion of the first panel member along with synchronous movement with the guide roller, controlling a swinging state of the guide roller and the bending roller caused by the swinging unit such that a bending angle of the peripheral edge portion of the first panel member from a panel plate surface of the first panel member gradually changes along with the movement.

BRIEF DESCRIPTION OF THE DRAWINGS

The accompanying drawings are included to provide a further understanding of the disclosure and are incorporated in and constitute a part of this specification. The drawings illustrate example embodiments and, together with the specification, serve to explain the principles of the disclosure.

DETAILED DESCRIPTION

Figure 1:
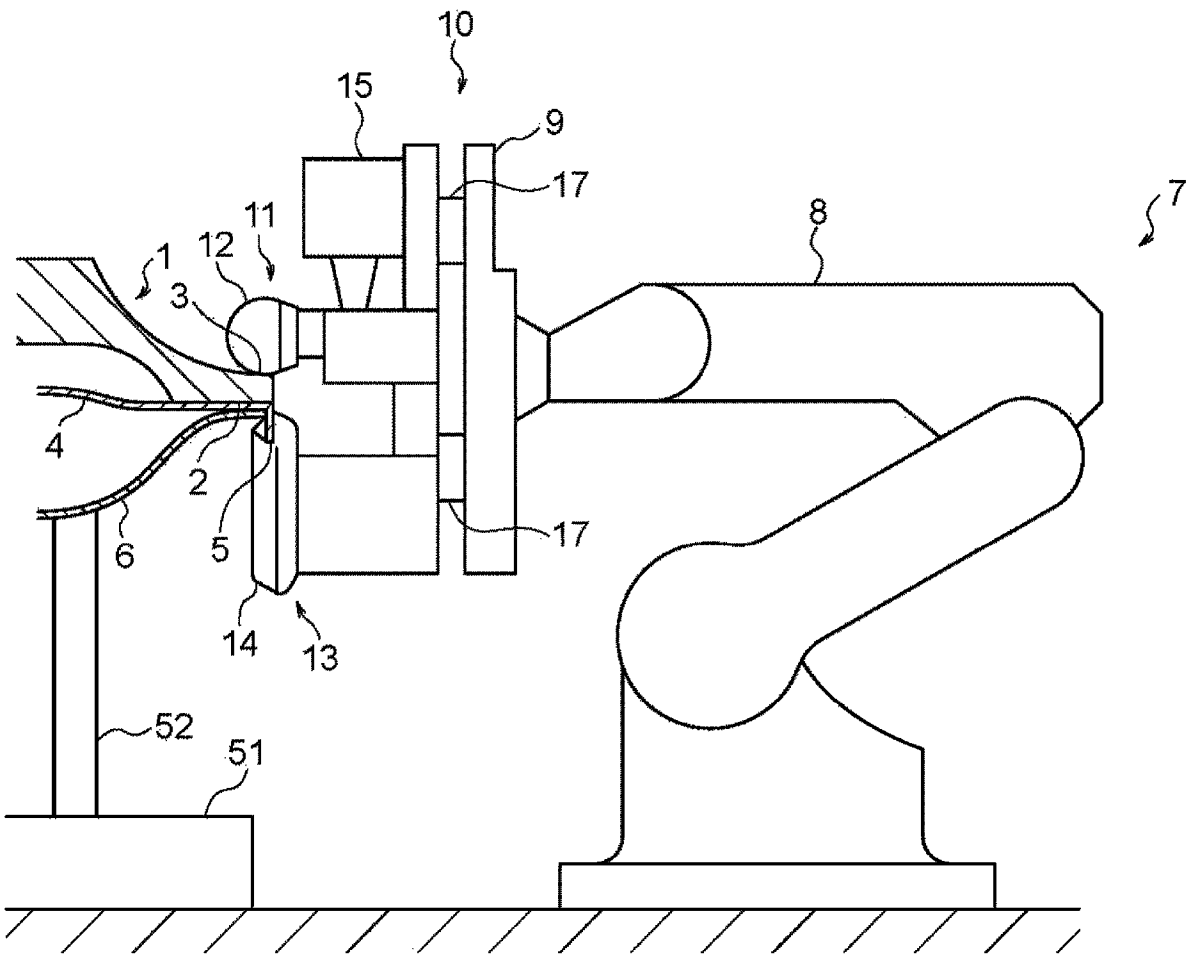
FIG. 1 is a front view illustrating a schematic configuration of a roller hemming device according to an embodiment for use in a preliminary bending method.

The guide surface of the backing metal is flat. As described in JP-A No. 2003-103325, the outer peripheral surface of the guide roller that rolls on the guide surface with abutting against the guide surface is an outer peripheral surface of a columnar or tubular body. Therefore, an angle between the guide surface of the backing metal and the substantially conical surface of the tapered portion of the bending roller is constant. In other words, the angle between the substantially conical surface of the tapered portion of the bending roller and the pre-bent first panel peripheral edge portion is constant. When the preliminary bending process is performed using the roller hemming device of a related art, the bending angle of the first panel peripheral edge portion is constant.

A preliminary bending process may include plural folding-back steps in each of which a bending roller folds back a first panel peripheral edge portion along with synchronous movement with a guide roller. In this preliminary bending process, a bending angle is changed (reduced) in each folding-back step. For example, in a first folding-back step, the bending angle of the first panel peripheral edge portion is 45 degrees, and in a second folding-back step, the bending angle is 30 degrees. When such a preliminary bending process including plural folding-back steps is performed using the roller hemming device of the related art, for example, after a folding-back step, a bending roller is to be retooled with another bending roller including a tapered portion that folds back the first panel peripheral edge portion at a different bending angle. Alternatively, the preliminary bending process is to be performed using another roller hemming device including such bending rollers, that is, the folding-back steps are to be separated from other processes. Further, there is an unsolved problem that when the first panel peripheral edge portion which is subject to the preliminary bending process extends with being curved in a plate surface direction of the panel member, the folded-back first panel peripheral edge portion is likely to be wrinkled along with the progress of the folding-back steps.

It is desirable to provide a roller hemming device and a preliminary bending method using the roller hemming device that do not need to retool a bending roller or separate the folding-back steps from the other processes even when a bending angle of a first panel peripheral edge portion is changed in each folding-back step, and that are capable of preventing an occurrence of wrinkles in a curved first panel peripheral edge portion.

In the following, an embodiment of the disclosure is described in detail with reference to the accompanying drawings. Note that the following description is directed to an illustrative example of the disclosure and not to be construed as limiting to the disclosure. Factors including, without limitation, numerical values, shapes, materials, components, positions of the components, and how the components are coupled to each other are illustrative only and not to be construed as limiting to the disclosure. Further, elements in the following example embodiment which are not recited in a most-generic independent claim of the disclosure are optional and may be provided on an as-needed basis. The drawings are schematic and are not intended to be drawn to scale. Throughout the present specification and the drawings, elements having substantially the same function and configuration are denoted with the same numerals to avoid any redundant description.

Figure 2:
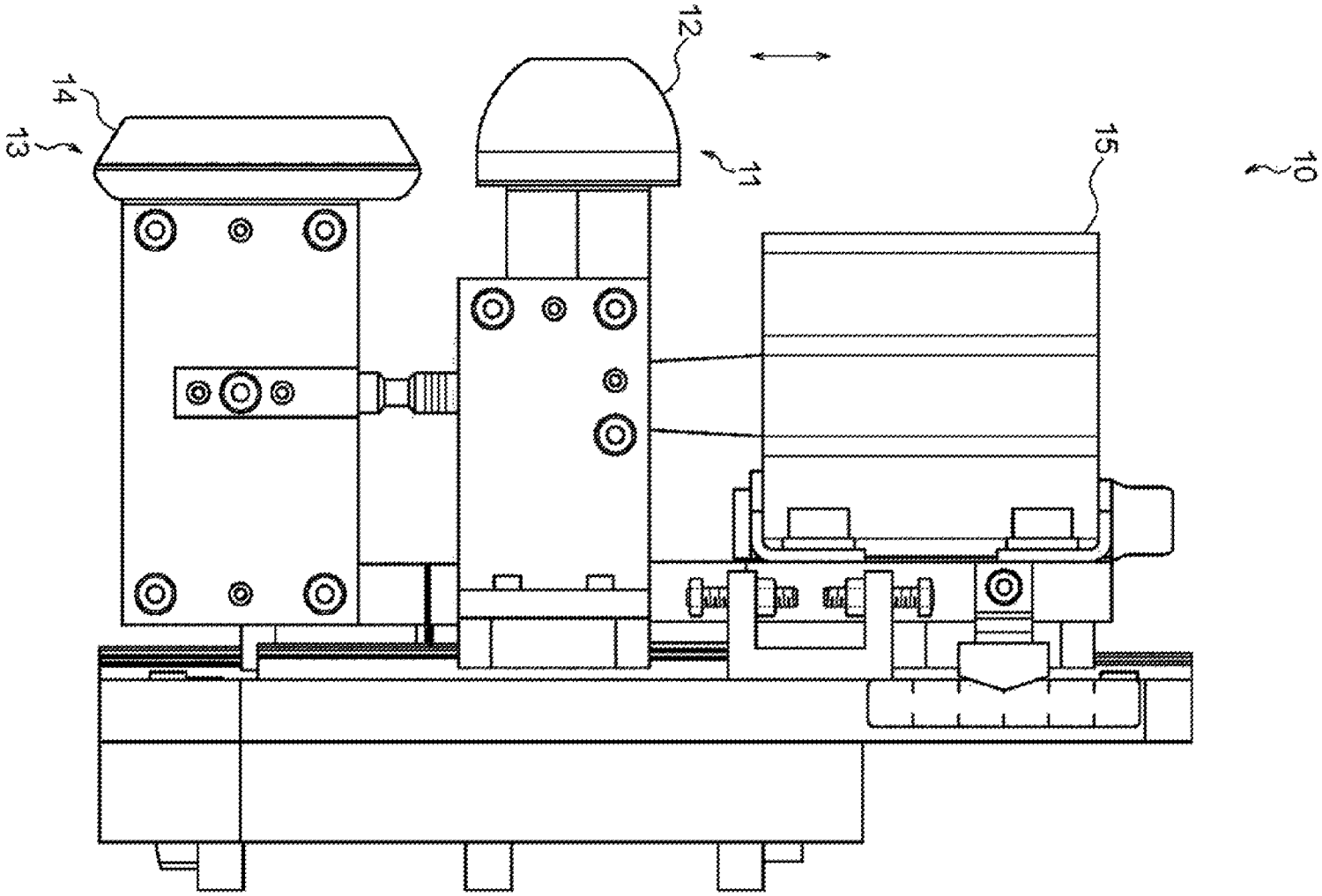
FIG. 2 is a view illustrating the roller hemming device of FIG. 1 in more detail.

FIG. 1 is a front view illustrating a schematic configuration of a roller hemming device 10 used in the preliminary bending method according to this embodiment. FIG. 2 is a detailed view of a part of the roller hemming device 10 illustrated in FIG. 1. First, panel members 4 and 6 which are subject to the preliminary bending process according to this embodiment and a backing metal 1 will be described. A lower surface of the backing metal 1 according to this embodiment has an abutment surface 2 that is brought into abutment against the superimposed panel members 4 and 6. Among the two panel members 4 and 6 which are subject to roller hemming, the first panel member 4 abuts against the abutment surface 2 of the backing metal 1, and the second panel member 6 is superimposed below the first panel member 4. The second panel member 6 is mounted on a plurality of support posts 52 protruding from a support base 51, so that the first panel member 4 and the second panel member 6 are supported. As illustrated in FIG. 1, a peripheral edge portion of the first panel member 4 is bent downward in advance to form a bending portion 5. A preliminary bending process is performed, that is, the bending portion 5 is folded at a predetermined bending angle back to a peripheral edge portion of the second panel member 6. Further, a formal bending process is performed, that is, the bending portion 5 is pressed against the peripheral edge portion of the second panel member 6. The bending portion of the first panel member 4 is bent substantially perpendicular to a plate surface of the first panel member 4. For example, the bending portion 5 of the first panel member 4 extends in a direction perpendicular to the paper of FIG. 1. A bending angle θ of the bending portion 5 (see FIGS. 3A and 3B) refers to a bending angle of the bending portion 5 from a panel plate surface after the preliminary bending process. The backing metal 1 may be simply present in a region in the vicinity of the bending portion 5 of the first panel member 4.

An upper surface of the backing metal 1 has a guide surface 3. The guide surface 3 is opposite to the abutment surface 2 of the backing metal 1. The guide surface 3 guides a guide roller 11 of the roll hemming device 10 which will be described later. For example, as described above, if the bending portion of the first panel member 4 extends in the direction perpendicular to the paper of FIG. 1, the guide surface 3 of the backing metal 1 also extends in the direction perpendicular to the paper. The guide surface 3 according to this embodiment is substantially horizontal when viewed in a cross-section of the first panel member 4 and the second panel member 6, that is, when viewed in a direction perpendicular to the paper of FIG. 1. However, the guide surface 3 does not need to be substantially horizontal in the direction perpendicular to the paper of FIG. 1, that is, in the extending direction of the guide surface 3. Further, the guide surface 3 and the abutment surface 2 may be inclined with respect to the horizontal direction of FIG. 1.

The roller hemming device 10 according to this embodiment is attached to a multi-axis industrial robot 7 (hereinafter, referred to as a "robot" 7). The roller hemming device 10 is moved by moving a manipulator 8 of the robot 7. The robot 7 is capable of moving the manipulator 8 to any position, in any direction and in any orientation within a movable range, so that the roller hemming device 10 attached to the manipulator 8 is moved to any position in any attitude and in any direction by so-called teaching. The operation of the robot 7 is controlled by a controller (not illustrated). Further, the robot 7 may be mounted on a moving device, for example, so as to be able to move along a floor surface.

A jig plate 9 is attached in a floating state to a distal end portion of the manipulator 8 of the robot 7 via a linear guide 17. The jig plate 9 extends in a substantially vertical direction. The roller hemming device 10 is provided on the jig plate 9. The roller hemming device 10 includes the guide roller 11, a bending roller 13, and a servomotor 15. The guide roller 11 is rotatably mounted on the jig plate 9. The bending roller 13 is disposed below the guide roller 11. The bending roller 13 is rotatably mounted on the jig plate 9. The servo motor 15 biases the guide roller 11 toward the bending roller 13 so as to relatively press the bending roller 13 toward the backing metal 1. In one embodiment, the servo motor 15 may serve as a "pressing unit".

The guide roller 11 is moved along the guide surface 3 by the robot 7 with abutting against the guide surface 3 of the backing metal 1, so as to roll on the guide surface 3. The guide roller 11 protrudes from the jig plate 9 toward the backing metal 1. The guide roller 11 is supported to be rotatable around an axis parallel to a direction in which the guide roller 11 protrudes. A curved surface portion 12 having a substantially hemispherical shape is formed on an outer peripheral surface of a protruding distal end portion of the guide roller 11. The curved surface portion 12 is brought into abutment against the guide surface 3 of the backing metal 1. That is, in this embodiment, the outer peripheral surface that is brought into abutment against the guide surface 3 of the backing metal 1 is formed as the curved surface portion 12. The curved surface portion 12 has the hemispherical shape, and thus forms a curved surface when viewed in the direction perpendicular to the paper of FIG. 1, that is, when viewed in a moving direction of the guide roller 11. A curved surface shape of the curved surface portion 12 is not limited to the hemispherical shape, but may be, for example, an oval cross section or an elliptical cross section. In some embodiments, the curved surface portion 12 has a spherical shape, that is, an arc cross section in order to simplify the control of a distance between the guide roller 11 and the bending roller 13, as will be described later. Since the guide roller 11 is moved along the guide surface 3 of the backing metal 1, the moving direction of the guide roller 11 according to this embodiment is the direction perpendicular to the paper of FIG. 1 as described above.

The bending roller 13 is brought into abutment against the bending portion 5 of the first panel member 4, and presses the bending portion 5 to fold back the bending portion 5. The bending roller 13 protrudes from the jig plate 9 to a position where the bending roller 13 faces the guide roller 11. The bending roller 13 is supported to be rotatable around an axis parallel to a direction in which the bending roller 13 protrudes. A tapered portion 14 having a substantially conical surface (precisely, a truncated conical surface) is formed at a protruding distal end portion of the bending roller 13. The tapered portion 14 is brought into abutment against the bending portion 5 of the first panel member 4 to press the bending portion 5. Therefore, an angle between the conical surface of the tapered portion 14 and the panel plate surface of the first panel member 4 is the bending angle of the bending portion 5.

In this embodiment, the guide roller 11 is moved in directions of arrows illustrated in FIG. 2 by rotating the servo motor 15, so as to change and adjust the distance between the guide roller 11 and the bending roller 13. The guide roller 11 is biased toward the bending roller 13 by the guide roller 11 and the bending roller 13 approaching each other. The bending roller 13 is pressed toward the backing metal 1 by a reactive force of a biasing force. As a result, the bending portion 5 of the first panel member 4 is pressed such that the bending portion 5 of the first panel member 4 is pinched between the guide roller 11 and the bending roller 13, and the bending portion 5 of the first panel member 4 is folded back to the peripheral edge portion of the second panel member 6 by the tapered portion 14 of the bending roller 13. A screw device or a gear mechanism (not illustrated) is interposed between the servo motor 15 and the guide roller 11. The pressing force with which the bending roller 13 presses the bending portion of the first panel member 4 is finely adjustable by controlling a torque of the servo motor 15. The distance between the guide roller 11 and the bending roller 13 is adjustable finely by controlling a rotation angle of the servo motor 15. The torque and the rotation angle of the servomotor 15 are controlled by a control unit (not illustrated). The control unit may be permanently affixed to or separate from the control unit of the robot 7, for example.

For example, an air cylinder may be used as the pressing unit. As described later, when the guide roller 11 and the bending roller 13 are integrally swung in a circumferential direction in a plane perpendicular to the moving direction of the guide roller 11 together with the jig plate 9 by using the manipulator 8 of the robot 7, the distance between the guide roller 11 and the bending roller 13 changes. In this embodiment, the distance between the guide roller 11 and the bending roller 13 is accurately changed according to a swinging state of the guide roller 11 and the bending roller 13, so that the guide roller 11 is appropriately brought into abutment against the guide surface 3 of the backing metal 1. In order to appropriately bring the tapered portion 14 of the bending roller 13 into abutment against the bending portion 5 of the first panel member 4, the servo motor 15 is used as a pressing unit.

Figure 3A:
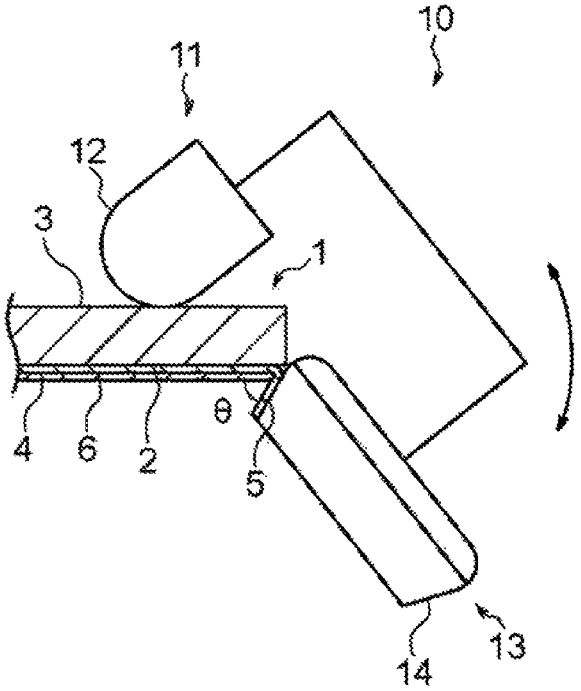
FIGS. 3A and 3B are views illustrating operation of the roller hemming device of FIG. 2.
Figure 3B:
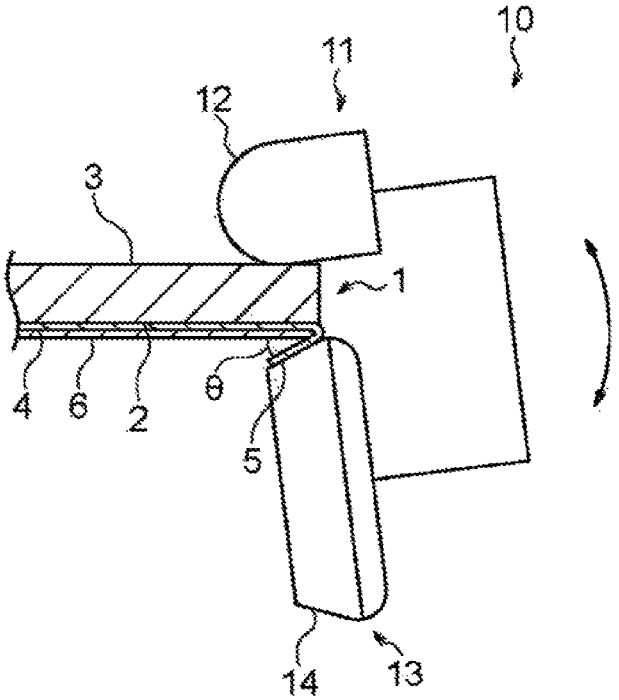

FIGS. 3A and 3B are views schematically illustrating the guide roller 11, the bending roller 13, the backing metal 1, the first panel member 4, and the second panel member 6 of the roller hemming device 10 of FIG. 1. The roller hemming device 10 according to this embodiment is supported by the manipulator 8 of the robot 7, and thus can be set in any attitude. Since the curved surface portion 12 of the guide roller 11 abuts against the guide surface 3 of the backing metal 1, the curved surface portion 12 and the guide surface 3 are in point contact with each other. Therefore, while the guide surface 3 of the backing metal 1 and the curved surface portion 12 of the guide roller 11 are in point contact with each other, the entire roller hemming device 10, for example, the guide roller 11 and the bending roller 13 can be integrally swung in the circumferential direction in the plane perpendicular to the moving direction of the guide roller 11, that is, in directions of arrows in FIGS. 3A and 3B. As a result, for example, when the guide surface 3 of the backing metal 1 is used as a reference, the angle between the conical surface of the tapered portion 14 of the bending roller 13 and the guide surface 3, that is, the bending angle of the bending portion 5 of the first panel member 4 can be changed.

For example, FIG. 3A illustrates a state where the guide roller 11 and the bending roller 13 are swung counterclockwise in the direction of the arrow in FIG. 3A. In this state, the bending angle θ of the bending portion 5 at which the tapered portion 14 of the bending roller 13 folds back the bending portion 5 is large. On the other hand, FIG. 3B illustrates a state where the guide roller 11 and the bending roller 13 are swung clockwise in the direction of the arrow in FIG. 3B. In this state, the bending angle θ of the bending portion 5 at which the tapered portion 14 of the bending roller 13 folds back the bending portion 5 is small.

The robot 7 changes the bending angle θ of the bending portion 5 at which the bending roller 13 folds back the bending portion 5. Thus, the bending angle θ of the bending portion 5 can be changed in a continuous manner or in a stepwise manner. In one embodiment, the robot 7 may serve as a "swinging unit". Therefore, even when the bending angle θ of the bending portion 5 in a subsequent folding-back step is smaller than that in a preceding folding-back step, for example, in a first folding-back step, the bending angle θ of the bending portion 5 is 45 degrees and in a second folding-back step, the bending angle θ is 30 degrees, this process can be performed by simply controlling the swinging state of the roller hemming device 10 caused by the robot 7, for example, simply controlling the swinging state of the guide roller 11 and the bending roller 13 by the robot 7.

Figure 4:
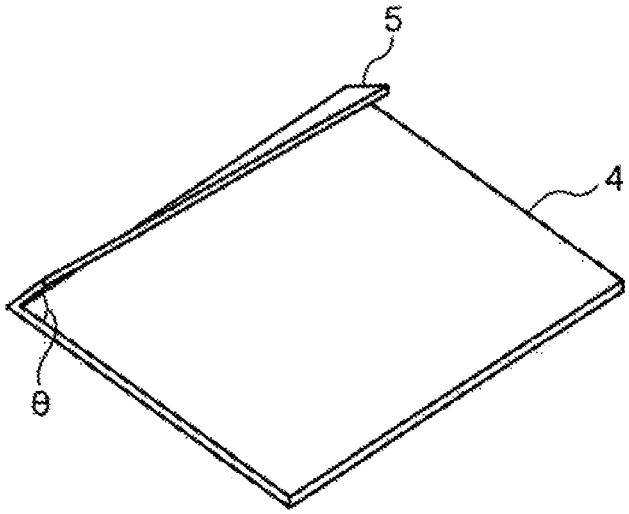
FIG. 4 is a view illustrating the preliminary bending method using the roller hemming device of FIG. 2.
Figure 5:
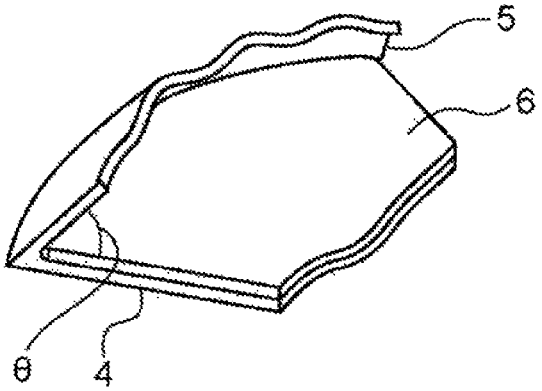
FIG. 5 is a view illustrating effect of a preliminary bending method using a roller hemming device of a related art.
Figure 6:
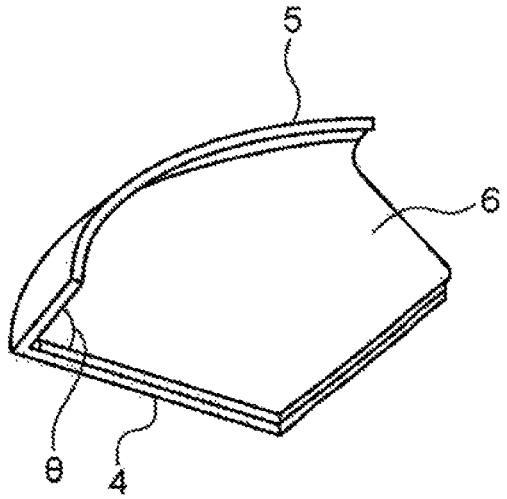
FIG. 6 is a view illustrating effect of the preliminary bending method using the roller hemming device of FIG. 2.

The bending angle θ of the bending portion 5 may be changed during one folding-back step. In order to facilitate understanding, FIG. 4 illustrates an example in which the bending portion 5, at the far side of the figure, of a rectangular panel member is preliminarily bent with the bending angle θ being gradually reduced from a front side to a rear side during one folding-back step. For example, when the bending portion 5 of the first panel member 4 is a curved bending portion that is curved in the panel plate surface direction, the preliminary bending process with a constant bending angle θ cannot make the occurrence of wrinkles uniform as illustrated in FIG. 5. In order to make the occurrence of wrinkles more uniform, the inventors intensively studied and found that when the bending angle θ of the bending portion 5 is gradually reduced along with the progress of the folding-back step, that is, the movement of the guide roller 11, the occurrence of wrinkles can be made substantially uniform. FIG. 6 illustrates an example in which the technique of continuously changing the bending angle as illustrated in FIG. 4 is performed for the curved bending portion 5 during one folding-back step. As a result of gradually reducing the bending angle θ from the front side to the rear side in FIG. 6, the occurrence of wrinkles can be made substantially uniform. This is because, along with the progress of the folding-back step, the material that tends to escape outward in the plate surface direction of the first panel member 4 is forcibly folded inward, so that the occurrence of wrinkles can be made substantially uniform.

In general, in a vehicle panel member, a height of the bending portion 5 (bending width) tends to be large at a center portion in a widthwise or longitudinal direction of a peripheral edge portion of the member, and tends to be smaller as approaching an end portion of the member. The smaller the height of the bending portion 5 is, the more difficult the preliminary bending process is performed. Therefore, when the bending portion 5 is folded from the central portion in an extending direction of the bending portion 5 to the end portion in the extending direction of the bending portion 5, the swinging state of the guide roller 11 and the bending roller 13 caused by the robot 7 is controlled such that the bending angle θ of the bending portion 5 is gradually reduced along with the progress of the folding-back steps, that is, the movement of the guide roller 11, so that the quality of preliminary bending process can be improved, and the occurrence of wrinkles can be substantially uniform.

Further, as is clear from FIGS. 3A and 3B, in FIGS. 3A and 3B, a distance between (i) a position (point) where the curved surface portion 12 of the guide roller 11 abuts against the guide surface 3 of the backing metal 1 and (ii) a position (line or point) where the tapered portion 14 of the bending roller 13 abuts against the bending portion 5 of the first panel member 4, that is, a distance between the guide roller 11 and the bending roller 13 changes. In this embodiment, by controlling the rotation angle of the servo motor 15, the distance between the guide roller 11 and the bending roller 13 can be changed and adjusted. This embodiment deals with the change in the distance between the guide roller 11 and the bending roller 13. When the guide roller 11 and the bending roller 13 are swung in the directions of the arrows in the drawings in a state where the guide roller 11 and the guide surface 3 are in point contact with each other, the position where the tapered portion 14 of the bending roller 13 abuts against the bending portion 5 of the first panel member 4, that is, the contact position between the tapered portion 14 of the bending roller 13 and the bending portion 5 of the first panel member 4 in a folding-back direction of the bending portion 5 also changes. In this embodiment, the robot 7 swings the roller hemming device 10. Thus, the position of the bending roller 13 in the folding-back direction of the bending portion 5 can be changed and adjusted, for example, by moving the guide roller 11 and the bending roller 13 integrally in the left and right directions in the drawings, so as to deal with a change of the contact position between the bending roller 13 and the bending portion 5.

As described above, in the roller hemming device 10 according to this embodiment, when viewed in the moving direction of the guide roller 11, the outer peripheral surface of the guide roller 11 is the curved surface portion 12 having the curved surface that is convex in the direction in which the bending portion 5 is pinched between the tapered portion 14 and the guide roller 11. In a state where the guide surface 3 and the curved surface portion 12 abut against each other, the guide roller 11 and the bending roller 13 swing integrally in the substantially circumferential direction in the plane perpendicular to the moving direction of the guide roller 11. With this structure, the guide roller 11 and the bending roller 13 are integrally swung in a state where the guide surface 3 of the backing metal 1 and the curved surface portion 12 of the guide roller 11 are in point contact with each other, so as to change the angle between the substantially conical surface of the tapered portion 14 of the bending roller 13 and the bending portion 5 of the first panel member 4. Accordingly, in a case where the bending angle θ of the bending portion 5 is changed in each folding-back step, if the swinging state of the guide roller 11 and the bending roller 13 is controlled such that the bending angle θ of the bending portion 5 is reduced in each folding-back step, it is possible to deal with the change in the bending angle θ of the bending portion 5 without retooling of the bending roller 13 or separation of the folding-back steps. Further, when the bending portion 5 is curved in the plate surface direction of the first panel member 4, the swinging state of the guide roller 11 and the bending roller 13 is controlled such that the bending angle θ of the bending portion 5 is reduced gradually during one folding-back step, so that the occurrence of wrinkles can be prevented.

The distance between the guide roller 11 and the bending roller 13 can be changed and adjusted. Thus, it is possible to deal with the change in the distance between (i) the position (point) where the guide roller 11 is in contact with the guide surface 3 of the backing metal 1 and (ii) the position (line or point) where the substantially conical surface of the tapered portion 14 of the bending roller 13 is in contact with the bending portion 5 of the first panel member 4 when the guide roller 11 and the bending roller 13 are swung integrally in the circumferential direction in the plane perpendicular to the moving direction of the guide roller 11. With this configuration, the guide roller 11 can be appropriately brought into abutment against the guide surface 3 of the backing metal 1. Also, the tapered portion 14 of the bending roller 13 can be appropriately brought into abutment against the bending portion 5 of the first panel member 4.

The position of the bending roller 13 in the folding-back direction of the bending portion 5 can be changed and adjusted. Thus, it is possible to deal with the change of the position where the substantially conical surface of the tapered portion 14 of the bending roller 13 is in contact with the bending portion 5 of the first panel member 4 when the guide roller 11 and the bending roller 13 are swung integrally in the circumferential direction in a plane perpendicular to the moving direction of the guide roller 11. With this configuration, the tapered portion 14 of the bending roller 13 can be appropriately brought into abutment against the bending portion 5 of the first panel member 4.

Figure 7:
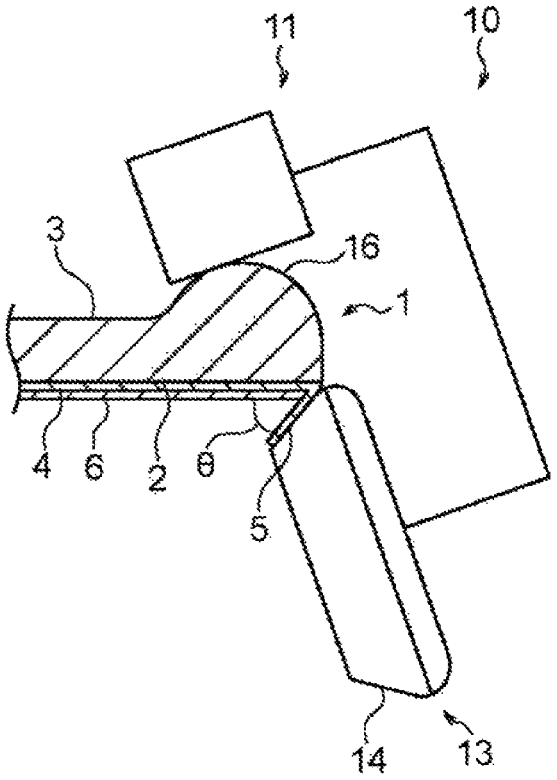
FIG. 7 is a view schematically illustrating a modification example of the roller hemming device of FIG. 2.

The roller hemming device and the preliminary bending method using the device according to the embodiment has been described above. It is noted that the disclosure is not limited to the configurations described in the above embodiment. Various modifications may be made within the scope of the gist of the disclosure. For example, in the embodiment described above, the outer peripheral surface of the guide roller 11 is the curved surface portion 12 having the substantially hemispherical shape. Alternatively, as illustrated in FIG. 7, the outer peripheral surface of the guide roller 11 may be a cylindrical surface, and the guide surface 3 of the backing metal 1 may be a curved surface portion 16 that is outwardly convex when viewed in the moving direction of the guide roller 11. When viewed in the moving direction of the guide roller 11, both the outer peripheral surface of the guide roller 11 and the guide surface 3 of the backing metal 1 may be curved surfaces that are convex in the direction in which the bending portion 5 of the first panel member 4 is pinched between the guide roller 11 and the bending roller 13.

In the above embodiment, detailed description has been made on an example in which the preliminary bending process is performed using the tapered portion 14 of the bending roller 13. For example, it is theoretically possible to perform the formal bending process by setting the bending angle θ at which the tapered portion 14 folds back the bending portion 5 of the first panel member 4 to 0 degree. The bending roller 13 may be provided with a circumferential portion having a cylindrical surface for a formal bending process in addition to the tapered portion 14 as described in JP-A No. 2003-103325, and the formal bending process may be performed using the same roller hemming device having such a circumferential portion.

According to the roller hemming device of the disclosure, the guide surface of the backing metal and the outer peripheral surface of the guide roller, at least one of which is a curved surface, are in point contact with each other. Thus, the guide roller and the bending roller can be integrally swung in the circumferential direction in the plane perpendicular to the moving direction of the guide roller in a state where the guide surface of the backing metal and the outer peripheral surface of the guide roller are in point contact with each other. With this configuration, it is possible to change the angle between (i) a pressing surface of the bending roller, for example, the substantially conical surface of the tapered portion and (ii) the bent peripheral edge portion of the first panel member (that is, the first panel peripheral edge). Therefore, in a case where the bending angle of the first panel peripheral edge portion from the panel plate surface is changed in each of plural folding-back steps, for example, if the swinging state of the guide roller and the bending roller is controlled such that the bending angle of the first panel peripheral edge portion is reduced in each folding-back step, it is possible to deal with the change in the bending angle of the first panel peripheral edge portion without retooling of the bending roller or separation of the folding-back steps. When the curved peripheral edge is curved in the panel plate surface direction of the first panel member, the swinging state of the guide roller and the bending roller is controlled such that the bending angle of the first panel peripheral edge portion is gradually reduced during one folding-back step, so that the occurrence of wrinkles can be prevented.

When the guide roller and the bending roller are integrally swung in the circumferential direction in the plane perpendicular to the moving direction of the guide roller, the distance between the position (point) where the guide roller is in contact with the guide surface of the backing metal and the position (line or point) where the pressing surface of the bending roller, for example, the substantially conical surface of the tapered portion is in contact with the pre-bent peripheral edge portion of the first panel member, that is, the distance between the guide roller and the bending roller, can be changed. It is possible to deal with the change in the distance. Therefore, the guide roller can be appropriately brought into contact with the guide surface of the backing metal, and the pressing surface of the bending roller, for example, the tapered portion can be appropriately brought into contact with the first panel peripheral edge.

When the guide roller and the bending roller are integrally swung in the circumferential direction in the plane perpendicular to the moving direction of the guide roller, the position where the pressing surface of the bending roller, for example, the substantially conical surface of the tapered portion is in contact with the first panel peripheral edge portion changes. It is possible to deal with the change of the contact position. Therefore, the pressing surface of the bending roller, for example, the tapered portion can be appropriately brought into abutment against the first panel peripheral edge portion.

According to the preliminary bending method of the disclosure, even when the bending angle of the first panel peripheral edge portion is changed in each of two or more folding-back steps for the peripheral edge portion of the first panel member, it is possible to easily deal with the change in bending angle of the first panel peripheral edge portion in each folding-back step without retooling of the bending roller or separation of the folding-back steps.

When the preliminary bending process is performed for the peripheral edge portion of the first panel member that is curved in the plate surface direction, or when the preliminary bending process is performed for the first panel peripheral edge portion from the central portion in the extending direction of the first panel peripheral edge portion to the end portion thereof in the extending direction, the swinging state of the guide roller and the bending roller is controlled so as to gradually reduce the bending angle of the first panel peripheral edge portion from the panel plate surface along with the movement of the guide roller. Thereby, the occurrence of wrinkles after the preliminary bending process can be prevented.

When the preliminary bending process is performed for the curved peripheral edge portion, the occurrence of wrinkles after the preliminary bending process can be prevented.

It is possible to prevent the occurrence of wrinkles at the end portion in the extending direction of the first panel peripheral edge portion which is difficult to be preliminarily bent and is likely to be wrinkled.

As described above, according to the disclosure, even when the bending angle of the first panel peripheral edge portion from the panel plate surface is changed in each folding-back step, it is possible to deal with the change in bending angle of the first panel member in each folding-back step without retooling of the bending roller or separation of the folding-back steps. Even when the curved peripheral edge is folded back, the occurrence of wrinkles can be prevented. Therefore, it is possible to improve the hemming quality and to significantly reduce the man-hours of the entire roller hemming process including the preliminary bending process.

The invention claimed is:

1. A roller hemming device comprising:

a backing metal comprising an upper surface, an abutment surface, and a guide surface extending along the upper surface of the backing metal, the guide surface opposite to the abutment surface, the abutment surface being configured to be brought into abutment against a first panel member among the first panel member and a second panel member superimposed with the first panel member;

a guide roller configured to be moved in an extending direction of the guide surface with abutting against the guide surface;

a bending roller disposed below the guide roller, the bending roller configured to, with being moved synchronously with the guide roller, press a bent peripheral edge portion of the first panel member via the backing metal such that the bent peripheral edge portion of the first panel member is pinched between the bending roller and the guide roller, and fold the bent peripheral edge portion of the first panel member back to a periphery edge portion of the second panel member;

a pressing unit biasing the guide roller toward the bending roller so as to press the bending roller toward the backing metal, wherein the pressing unit is configured to change and adjust a distance between the guide roller and the bending roller, and wherein the pressing unit comprises either (1) a servo motor and a gear mechanism or (2) an air cylinder; and a swinging unit attached to the guide roller, the bending roller, and the pressing unit, wherein when viewed in a moving direction of the guide roller, at least one of the guide surface or an outer peripheral surface of the guide roller configured to be brought into abutment against the guide surface is a curved surface that is convex in a direction in which the bent peripheral edge portion of the first panel member is pinched between the bending roller and the guide roller, and the swinging unit is configured to swing the guide roller and the bending roller integrally in a plane perpendicular to the moving direction of the guide roller, with the guide surface and the outer peripheral surface abutting against each other.

2. The roller hemming device according to claim 1, wherein the swinging unit is configured to change and adjust a position of the bending roller in a folding-back direction of the peripheral edge portion of the first panel member.

3. The roller hemming device according to claim 1, wherein the swinging unit is a robot, the robot comprising:

a controller; and a manipulator, wherein the manipulator is configured to move to any position in any attitude and in any direction.

4. A preliminary bending method using the roller hemming device according to claim 1, the method comprising:

during two or more folding-back steps each comprising the bending roller folding back the peripheral edge portion of the first panel member along with synchronous movement with the guide roller, controlling a swinging state of the guide roller and the bending roller caused by the swinging unit such that a bending angle of the peripheral edge portion of the first panel member from a panel plate surface of the first panel member in a subsequent folding-back step is smaller than that in a preceding folding-back step.

5. A preliminary bending method using the roller hemming device according to claim 2, the method comprising:

during two or more folding-back steps each comprising the bending roller folding back the peripheral edge portion of the first panel member along with synchronous movement with the guide roller, controlling a swinging state of the guide roller and the bending roller caused by the swinging unit such that a bending angle of the peripheral edge portion of the first panel member from a panel plate surface of the first panel member in a subsequent folding-back step is smaller than that in a preceding folding-back step.

6. A preliminary bending method using the roller hemming device according to claim 1, the method comprising:

during one folding-back step comprising the bending roller folding back the peripheral edge portion of the first panel member along with synchronous movement with the guide roller, controlling a swinging state of the guide roller and the bending roller caused by the swinging unit such that a bending angle of the peripheral edge portion of the first panel member from a panel plate surface of the first panel member gradually changes along with the movement.

7. The preliminary bending method according to claim 6, wherein when (i) the peripheral edge portion of the first panel member is curved and (ii) the peripheral edge portion of the first panel member is to be folded back, the swinging state of the guide roller and the bending roller caused by the swinging unit is controlled such that the bending angle of the peripheral edge portion of the first panel member from the panel plate surface of the first panel member gradually reduces along with the movement.

8. The preliminary bending method according to claim 6, wherein when the peripheral edge portion of the first panel member is to be folded back from a central portion in an extending direction of the peripheral edge portion of the first panel member to an end portion in the extending direction of the peripheral edge portion of the first panel member, the swinging state of the guide roller and the bending roller caused by the swinging unit is controlled such that the bending angle of the peripheral edge portion of the first panel member from the panel plate surface of the first panel member gradually reduces along with the movement.

9. A preliminary bending method using the roller hemming device according to claim 2, the method comprising:

during one folding-back step comprising the bending roller folding back the peripheral edge portion of the first panel member along with synchronous movement with the guide roller, controlling a swinging state of the guide roller and the bending roller caused by the swinging unit such that a bending angle of the peripheral edge portion of the first panel member from a panel plate surface of the first panel member gradually changes along with the movement.

10. The preliminary bending method according to claim 9, wherein when (i) the peripheral edge portion of the first panel member is curved and (ii) the peripheral edge portion of the first panel member is to be folded back, the swinging state of the guide roller and the bending roller caused by the swinging unit is controlled such that the bending angle of the peripheral edge portion of the first panel member from the panel plate surface of the first panel member gradually reduces along with the movement.

11. The preliminary bending method according to claim 9, wherein when the peripheral edge portion of the first panel member is to be folded back from a central portion in an extending direction of the peripheral edge portion of the first panel member to an end portion in the extending direction of the peripheral edge portion of the first panel member, the swinging state of the guide roller and the bending roller caused by the swinging unit is controlled such that the bending angle of the peripheral edge portion of the first panel member from the panel plate surface of the first panel member gradually reduces along with the movement.

* * * * *